US005421771A

United States Patent [19]

Wardle

[11] Patent Number: 5,421,771

[45] Date of Patent: Jun. 6, 1995

[54] LENS BLOCKING

[76] Inventor: Thomas W. Wardle, 29 Browns Way, Aspley Guise, Milton Keynes MK17 8JA, United Kingdom

[21] Appl. No.: 200,475

[22] Filed: Feb. 23, 1994

[30] Foreign Application Priority Data

Mar. 5, 1993 [GB] United Kingdom ..... 9304468

[51] Int. Cl.[6] ..... B24B 41/06; B24B 13/005

[52] U.S. Cl. ..... 451/390; 451/384; 359/819

[58] Field of Search ..... 51/216 LP; 451/384, 451/390; 359/819, 820

[56] References Cited

U.S. PATENT DOCUMENTS 3,383,808 5/1965 Deshayes et al. ..... 51/216 LP
4,089,102 5/1978 Soper et al. ..... 51/216 LP
4,158,273 6/1979 Olsen et al. ..... 51/216 LP
5,177,907 6/1993 Rothe et al. ..... 51/216 LP

*Primary Examiner*—Loha Ben
*Assistant Examiner*—Audrey Chang
*Attorney, Agent, or Firm*—Iandiorio & Teska

[57] ABSTRACT

A lens blocking system in which a button is bonded to a lens surface. The button includes a capsule (2) of flowable substance with a flexible portion (3) that is brought into contact with and bonded to the lens surface. The flowable substance allows the flexible portion to conform to the shape of the lens surface, subsequent to which flow is then inhibited. The flowable substance may be a substance that is molten and then subsequently cooled to solidifying temperature after the button has been bonded to the lens.

22 Claims, 2 Drawing Sheets

LENS BLOCKING

This invention relates to provision of a flexible adhesive mounting, in particular but not exclusively applicable to the blocking of lenses on to a button via which the lens is held for subsequent processing operations.

Approximately 40% of the people requiring spectacles need custom made lenses, by which is meant a lens of a configuration sufficiently individual that a finished lens is unlikely to be held as standard stock. One of the main reasons for requiring non standard lenses is astigmatism which necessitates a toric lens.

For the preparation of non-standard lenses it is usual for the lens processing laboratory to hold stock of mass produced semi-finished lenses, i.e. lenses having one surface ground and polished (i.e. finished) but with the other surface available for individual working. Usually the finished surface is the one that will be the outward facing convex lens surface in the finished spectacles for better cosmetic appearance.

In order to hold the semi-finished lens for the generation (when the lens is cut or ground) smoothing and polishing stages required to manufacture the custom finished lens it is necessary to mount the lens on a button assembly (button and mounting substance), this process being known as blocking. The machine employed in this process is called a blocker (examples being Autoflow 300 Series: Coburn 900: LOH 2000). It is usual for the finished surface (normally convex/front) of the lens to be protected by adhesive tape or lacquer. A hard metal button is put into the blocker, the lens is then put in a prescribed position in line with the metal button and a space between the button and the protected lens surface is filled with a substance such as low melting point alloy which on solidification forms a bond between the hard metal button and the protected lens surface.

The front surface of the semi-finished lenses have a variety of shapes and curves and to get a sufficiently mechanically strong bond between the lens surface and the button it is necessary to use a bonding material that will conform to the surface of the lens. Further, modern plastic lenses are heat sensitive which restricts the choice of bonding materials to those that do not need to be applied at a high temperature. The most commonly used technique for bonding during the blocking process, as previously mentioned, is to use a low melting point alloy which is flowed into a hollow space between the button and lens. The alloy then rapidly solidifies to form a bonding interface between the inner surface of the button and the protected surface of the lens in a prescribed position. After the lens has been finished the alloy and button can be removed by immersion in a hot water bath system (known as a reclaim tank) that remelts the alloy, the alloy being recovered for reuse by draining from the bottom of the reclaim tank via a pipe and tap. With plastic lenses the button and lens may be separated by mechanical shock before the button with solidified alloy is placed into the alloy reclaim tank.

Unfortunately the low melting point alloys contain materials such as lead, cadmium and indium which can give rise to potential health hazards for those working with them. Other substances have been employed instead of low melting point alloy, but are generally regarded as a poor substitute.

The present invention is directed to providing an alternative method of bonding the lens and button, overcoming the above problem of potentially hazardous contact with low melting point alloy.

Accordingly the invention provides a lens blocking system in which a button is bonded to a lens surface, the button comprising a capsule enclosing a flowable substance and having a flexible portion for bringing into contact with the surface and conforming thereto by substance flow within the capsule.

Preferably the flowable substance comprises a lens blocking system in which the flowable substance comprises a material that becomes molten above ambient temperature but solidifies at ambient temperature and the substance is heated to above ambient temperature to enable the flexible portion of the capsule to conform to the lens surface.

The mounting system is particularly suitable for lens blocking but may also be used for mounting to other delicate objects.

By 'ambient temperature' is meant the temperature at which the mounting is utilised. This will usually be near room temperature, but in some instances the ambient machining temperature may be higher or lower.

The invention will now be described by way of example with reference to the accompanying drawings in which.

Figure 1A:
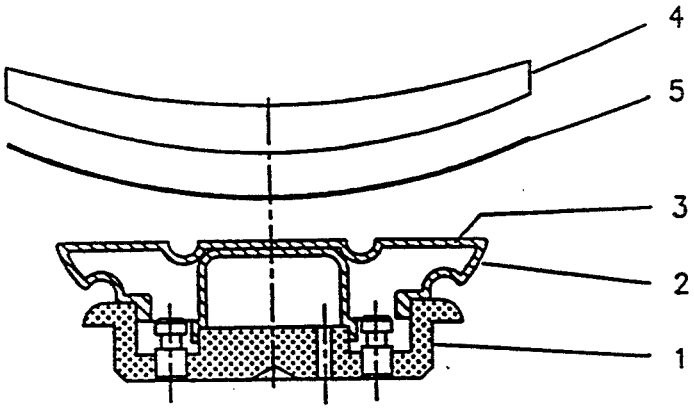
FIG. 1A is a schematic sectional view of a lens and button according to the present invention prior to bonding.

In the drawings, FIGS. 1A, 2A, 3A and 4A illustrate the invention in combination with a 'Coburn' type button. FIGS. 1B, 2B, 3B and 4B illustrate the invention employing a 'LOH' type button. Like references are used for the corresponding parts and the A and B Figures are referred to collectively hereinafter.

Referring to FIGS. 1 and 2, a preferred embodiment of the lens mounting system of the present invention utilizes a button 1 that carries a capsule 2 having a flexible front membrane 3 capable of conforming to the shape of a lens or other delicate object with which it is brought into contact. The capsule 2 is filled with a low melting point material, typically one which melts in the range of 45 ° to 65° C. Suitable materials include low melting point alloys and waxes. Alternatively substances that are flowable under suitable conditions may be used.

When the material in the capsule is flowable, the flexible membrane 3 may be placed against a protected lens surface 4 to conform therewith, as shown in FIG. 2. The membrane and protected lens surface are preferably brought together with an intervening adhesive agent. Once the material in the capsule has solidified, the structure becomes rigid and membrane 3 retains its adapted form. This procedure provides a button mounting of a shape conformed to that of the lens surface in a specified lens position against the member 3. With this procedure the bending process occurs at the same time as the capsule is conformed to the lens surface but it is possible to separate the stages, first conforming the membrane and then subsequently interposing the adhesive.

In the preferred embodiment a flexible double sided adhesive tape or pad 5 is used as the bending material. This pad is stuck on to the protective surface on the finished side of the lens, which may itself be another layer of tape. In a modification, the protective tape covering the lens surface may incorporate or consist of double sided adhesive tape or substance. For alignment and positioning purposes the membrane has a graticule marked centre and the central portion (approximately 15 mm diameter) of the lens adhesive medium needs to be free of adhesion.

Figure 1B:
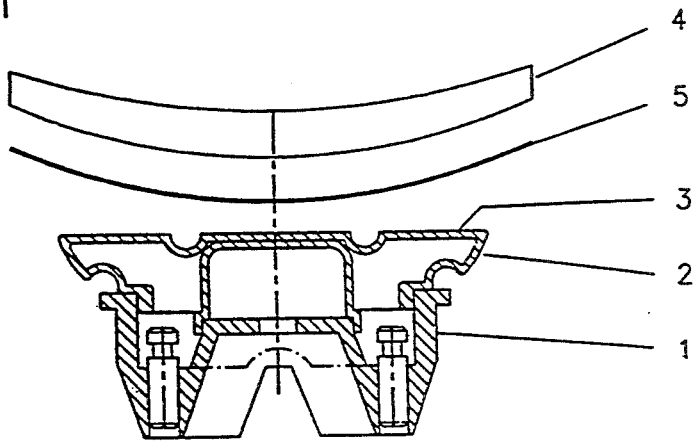
FIG. 1B is a schematic sectional view of a lens and a different button type, according to the invention prior to bonding.
Figure 2A:
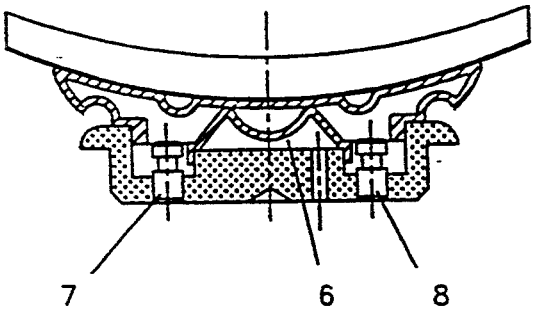
FIG. 2A is a schematic sectional view of the lens and button of FIG. 1A after bonding.
Figure 2B:
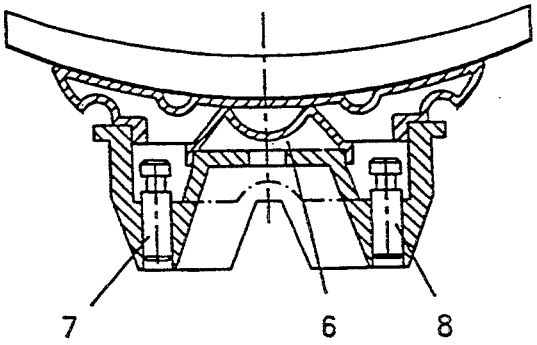
FIG. 2B is a schematic section view of the lens and button of FIG. 1B after bonding.
Figure 3A:
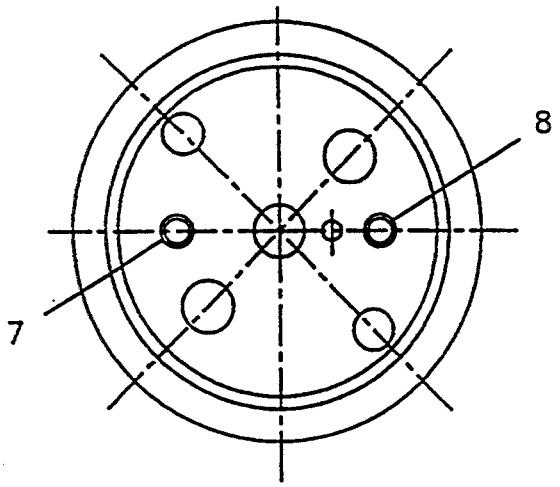
FIG. 3A is a plan view of the button of FIG. 1A viewed from the end away from the lens.
Figure 3B:
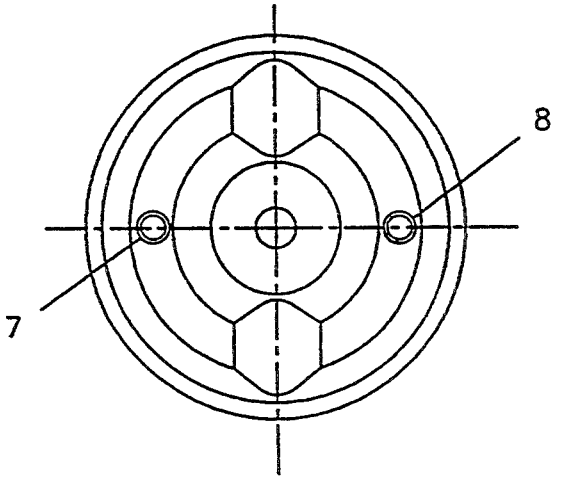
FIG. 3B is a plan view of the button of FIG. 1B viewed from the end away from the lens.
Figure 4A:
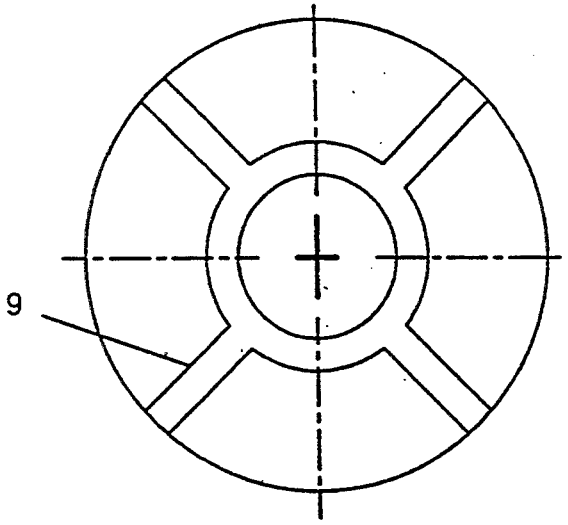
FIG. 4A is a plan view of the membrane of FIG. 1A viewed from the end adjacent the lens.
Figure 4B:
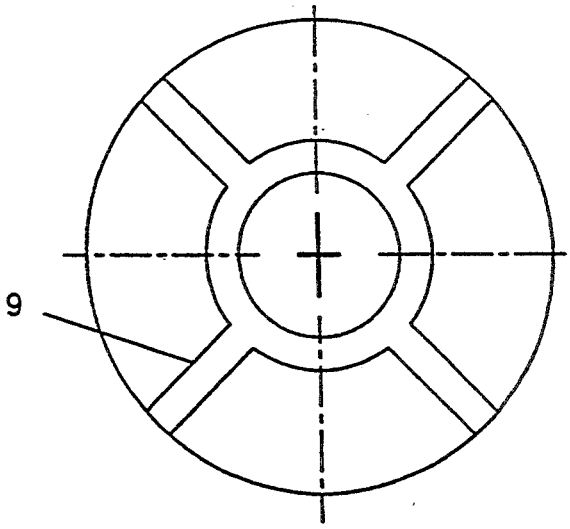
FIG. 4B is a plan view of the membrane of FIG. 1B viewed from the end adjacent the lens.

The capsule 2 may be of rubber, plastics or a composite material. The capsule may be formed from flexible material entirely or a combination of flexible and hard materials relative to application requirements. The sides of the capsule can be flexible or rigid depending upon blocking procedure employed. The wall of the capsule 2 may be of different flexibility, consistency, thickness than the membrane 3. Part of the capsule wall may be formed by a portion of an integral button. As the flexible surface 3 is flexed into conformity with the lens surface when the encapsulant is molten, the membrane will itself be at above room temperature and may advantageously be made of a material having greater flexibility at higher temperature, but less flexibility at room temperature to minimize shear in the membrane during machining operations. A supporting ring of metal or other rigid material 10 (as shown in FIG. 1B) may be inserted inside the capsule on the underside of the membrane around its inner circumference edge in order to avoid the tendency of the capsule wall drawing towards the centre by depressing the membrane at the centre.

When the membrane is conformed to the lens surface, flowing encapsulant is displaced inwardly and this is accommodated by the flexible rear surface 6 of the capsule bulging outwardly as shown in FIG. 2. The metal part of the button is suitably vented to enable air to escape as the rear part of the capsule bulges.

The capsule is formed or joined with the metal button before being filled with encapsulant. Once the capsule is formed with the button the capsule is filled with molten encapsulant via one of the apertures 7 or 8, the other aperture permitting displaced air to escape. Once the capsule has been filled the apertures are plugged using dowels or similar which may also act as a securing device on solidified encapsulant.

To aid flexibility, the membrane may have varying thickness regions. FIG. 4 shows the top surface of a membrane which has grooves or depressions 9 which improve membrane stability when the encapsulant has solidified. Not all membrane surfaces need be provided with grooves. In the embodiment shown the membrane has a thickness of 1 mm with the grooves having a depth of 3 mm.

A particularly preferred encapsulant is low melting point alloy such as bismuth/tin/lead/cadmium/indium alloy. Although this alloy is potentially toxic the harmful effects are eliminated by virtue of its encapsulation, in contrast to the prior art situation where contact with the alloy is possible. A further advantage of encapsulation is that the alloy does not oxidise, leading to longer working life for the alloy.

It has also been found that the interposition of the membrane between the heated encapsulant and the lens reduces the thermal shock to the lens. In some instances this also enables slightly higher melting point encapsulants to be used than could be brought into direct contact with the protected surface of the lens.

Wax or other materials may also be used as the encapsulant. As wax does not cool as quickly as alloy (due to lower thermal conductivity) it increases the time taken to complete the bonding. With wax, alloy, or other encapsulant material cooling and solidification may be accelerated by chilled water or other coolant being circulated through a hollow chilling ring or other device interfacing with side wall 2 of the capsule. Prior to mounting on a lens the button and capsule assembly may be kept at the temperature required to melt the encapsulant, for example in a heated water bath system.

Once the lens processing operation has been finished the lens and capsule are separated and the capsule and button are heated for re-use. In the event that treatment other than heating causes flowability, appropriate alternative procedures are used to induce flowability.

It will be appreciated that in addition to reducing toxic hazard at the blocking stage the mounting system also avoids the need for low melting point alloy reclaim and filling of the blocker machine, further reducing alloy handling. Also, the system facilitates a simpler blocker machine design as alloy holding tanks, heating and alloy delivery are no longer required as integral components.

Modification to the basic shape of the membrane may be utilised to facilitate conforming, particularly to highly curved or aspheric surfaces. For example the membrane may have a convex shape or, for attachment to the front surface of the lens, a concave shape.

Alternative heating, treating or conditioning methods, may be utilised to achieve encapsulant flow. In some instances the membrane may be brought into contact with the lens with the encapsulant in a solidified state and subsequently treated to achieve the flexible conforming state of the membrane and encapsulant. The system for treating, if a thermal system, could be similar to that previously referred to for solidifying the encapsulant employing for example heated water instead of chilled water or other coolant.

I claim:

1. A lens blocking system for bonding a button to a lens surface, the button comprising:

a rigid portion and a capsule, said capsule having front, rear and side walls defining an enclosed volume for retaining and isolating a flow inducible substance from ambient atmosphere and the lens surface, said front wall comprising a flexible portion for bringing into contact with the lens surface and adopting a conformed configuration thereto when flow is induced in said flow inducible substance, said flow inducible substance subsequently setting to retain the flexible portion of the capsule in said conformed configuration.

2. The lens blocking system of claim 1 in which the flow inducible substance comprises a material that becomes molten above ambient temperature but solidifies at ambient temperature and the substance is heated to above ambient temperature to enable the flexible portion of the capsule to conform to the lens surface.

3. The lens blocking system of claim 1 in which a bonding substance is interposed between the flexible portion and the lens surface and the flexible portion contacts the lens surface via the bonding substance.

4. The lens blocking system of claim 1 in which the capsule comprises a further flexible or elastic portion which accommodates flowing movement as the flexible portion conforms to the surface.

5. The lens blocking system of claim 4 in which the capsule comprises a separate flexible body that engages with a rigid portion of the button.

6. The lens blocking system of claim 4 in which the capsule comprises a flexible body that engages with a rigid portion of the button so that the rigid portion forms part of the capsule walls.

7. The lens blocking system of claim 4 in which a rigid material is inserted within the capsule around its periphery.

8. The lens blocking system of claim 1 in which the flexible portion comprises regions of greater and lesser thickness.

9. The lens blocking system of claim 1 in which the flexible portion comprises rigid or recessed formations.

10. The lens blocking system of claim 1 in which the flexible portion is rubber.

11. The lens blocking system of claim 1 in which the flowable substance comprises low melting point alloys.

12. In a lens blocking apparatus of the type in which a button is bonded to a lens surface with low melting point substance, the improvement comprising:

isolating the substance from ambient atmosphere and the lens surface within a capsule attached to the button, the capsule having a flexible portion for bringing into engagement with the lens surface and conforming thereto when the substance is melted, the substance being retained entirely within the capsule prior to, during and upon removal from engagement with the lens and the capsule being reusable for attachment to another lens by remelting the substance in situ within the capsule.

13. The improvement of claim 12 in which the flow inducible substance comprises a material that becomes molten above ambient temperature but solidifies at ambient temperature and the substance is heated to above ambient temperature to enable the flexible portion of the capsule to conform to the lens surface.

14. The improvement of claim 12 in which a bonding substance is interposed between the flexible portion and the lens surface and the flexible portion contacts the lens surface via the bonding substance.

15. The improvement of claim 12 in which the capsule comprises a further flexible or elastic portion which accommodates flowing movement as the flexible portion conforms to the surface.

16. The improvement of claim 15 in which the capsule comprises a separate flexible body that engages with a rigid portion of the button.

17. The improvement of claim 15 in which the capsule comprises a flexible body that engages with a rigid portion of the button so that the rigid portion forms part of the capsule walls.

18. The improvement of claim 15 in which a rigid material is inserted within the capsule around its periphery.

19. The improvement of claim 12 in which the flexible portion comprises regions of greater and lesser thicknesses.

20. The improvement of claim 12 in which the flexible portion comprises rigid or recessed formations.

21. The improvement of claim 12 in which the flexible portion is rubber.

22. The improvement of claim 12 in which the flowable substance comprises low melting point alloys.

* * * * *